United States Patent [19]

Mountford

[11] 4,091,872

[45] May 30, 1978

[54] ADJUSTABLE DRY PENDENT SPRINKLER

[75] Inventor: George S. Mountford, Chippewa Lake, Ohio

[73] Assignee: A-T-O Inc., Willoughby, Ohio

[21] Appl. No.: 766,767

[22] Filed: Feb. 7, 1977

[51] Int. Cl.[2] ..... A62C 39/00

[52] U.S. Cl. ..... 169/37

[58] Field of Search ..... 169/37–41, 169/90

[56] References Cited

U.S. PATENT DOCUMENTS

| | | | |
|---|---|---|---|
| 2,291,813 | 8/1942 | Knight | 169/37 |
| 2,768,696 | 10/1956 | Sherburne | 169/37 |
| 3,061,015 | 10/1962 | Cann, Jr. | 169/41 |
| 3,080,000 | 3/1963 | Gloeckler | 169/41 |
| 3,529,671 | 9/1970 | Adams, Jr. | 169/41 |

*Primary Examiner*—Robert W. Saifer

*Attorney, Agent, or Firm*—Webster B. Harpman

[57] ABSTRACT

An adjustable dry pendent sprinkler for fire extinguishing sprinkler systems incorporates a heat fusible sprinkler head on an elongated telescopically adjustable device threadably engagable in a horizontal sprinkler main or the like and isolated therefrom by a frangible disc. The device contains a pair of telescopically engaged tubular members both of which are capable of longitudinal movement and one of which is held in a first position by the sprinkler head. A plurality of spheres are radially movable between oppositely disposed configurations of the tubular members so that fusing of the sprinkler head, opening the same, permits one of the tubular members to move into the area occupied by the sprinkler head thereby freeing the spheres to move radially and permit the other of the tubular members to be spring urged toward the frangible disc so as to cut the same and thereafter form a tubular passageway through the device for the delivery of fire extinguishing fluid therethrough.

6 Claims, 2 Drawing Figures

ADJUSTABLE DRY PENDENT SPRINKLER

BACKGROUND OF THE INVENTION (1) Field of the Invention

This invention relates to dry pendent sprinklers of the type normally employed to position a fire extinguishing sprinkler head below a ceiling or the like in communication with a sprinkler main thereabove.

(2) Description of the Prior Art

Prior dry pendent sprinklers have generally comprised such devices as seen in U.S. Pat. No. 2,291,818 wherein fusing of a sprinkler head on one end of the device permits a telescopically arranged tubular member incorporating a valve element, normally closed, to move to open position as it moves upwardly into a sprinkler main. U.S. Pat. No. 2,768,696 shows a similar arrangement wherein the tubular device acts as a cutter and moves to sever a sealing disc. Neither of these dry pendent sprinklers are adjustable as to overall length. U.S. Pat. No. 2,291,813 shows a construction similar to that of U.S. Pat. No. 2,291,818.

This invention provides a dry pendent sprinkler which is also adjustable as to overall length, permitting it to be installed through a hole in a ceiling, turned into watertight relation in a sprinkler main and then adjusted as to length as by shortening the same to bring the sprinkler head into desired position beneath the ceiling.

SUMMARY OF THE INVENTION

An adjustable dry pendent sprinkler comprises a telescopically arranged assembly of tubular members, the innermost two of which are normally urged in opposite directions by a coil spring positioned therebetween and the outer two of which are arranged to be freely rotated with respect to one another or alternately locked to one another so that the entire device can be forcefully threadably engaged in a hidden fitting in a sprinkler main or the like with a heat fusible sprinkler head normally closing the fluid passage through the device and holding the relatively movable parts in a predetermined inoperative position with respect to a frangible disc positioned to exclude fluid from the interior of the device until such time as the fusible sprinkler fuses responsive to a predetermined temperature.

DESCRIPTION OF THE PREFERRED EMBODIMENT

Figure 1:
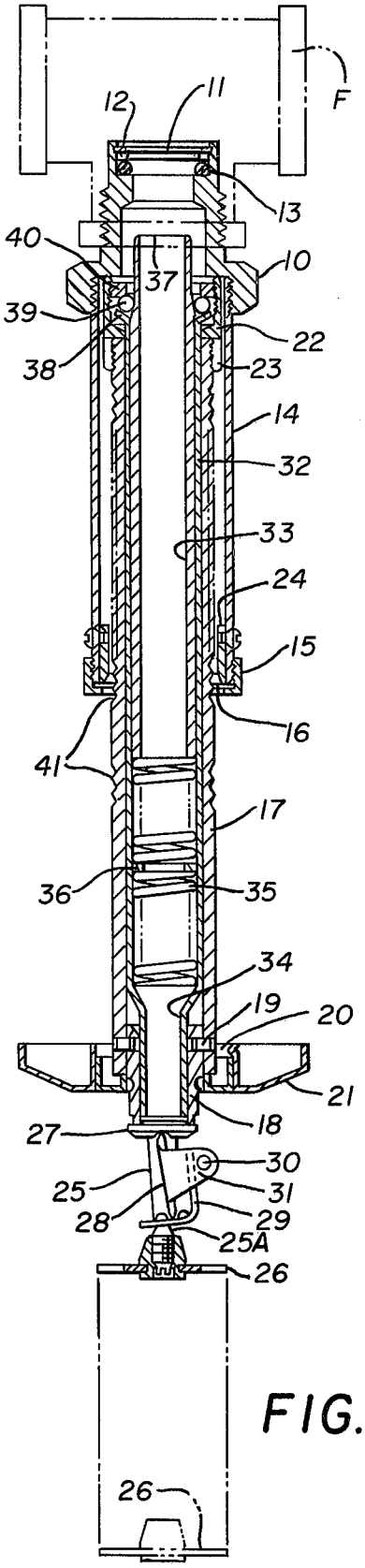
FIG. 1 is a vertical section through an adjustable dry pendent sprinkler showing a heat fusible sprinkler head in closed position; broken lines in FIG. 1 indicate the length of adjustment possible with the device.

In the form of the invention chosen for illustration and description herein, the adjustable dry pendent sprinkler comprises a top cap 10 having internal and external threaded areas, the external threaded area being illustrated as positioned in a broken line representation of a fitting F in a sprinkler main. The top cap 10 is apertured at its upper end and normally closed by a frangible disc 11 which is held in liquid-tight position by a snap ring 12 against an O-ring 13.

A cylindrical barrel 14 is threadably engaged in the internal thread pattern of the top cap 10 adjacent its lower end and extends downwardly and threadably receives a disc retainer 15 on its lower end. An apertured disc 16 retained thereby slidably engages a telescopically engaged tubular fitting 17 which is considerably longer than the cylindrical barrel 14 as shown in FIG. 1 of the drawings.

A sprinkler frame 18 is secured in the lower end of the tubular fitting 17 by pins 19. An adapter ring 20 is positioned around the exterior of the lower end of the tubular fitting 17 and serves to mount an escutcheon plate 21. The upper or opposite end of the tubular fitting 17 is threadably engaged in a slide fitting 22 which has a pair of oppositely disposed cutaway areas defining pockets 23 formed therein and arranged for registry with a pair of oppositely disposed lugs 24 fastened to the inner surface of the cylindrical barrel 14 adjacent its lowermost end. Those skilled in the art will observe that when the tubular fitting 17 is moved downwardly relative to the cylindrical barrel 14, the engagement of the lugs 24 in the pockets 23 in the slide fitting 22 will enable the cylindrical barrel 14 and the top cap 10 to be forcefully rotated as by the application of a wrench to the lower portion of the tubular fitting 17, as may be desirable when the device is being installed upwardly through a hole in a ceiling and into the fitting F in a sprinkler main, heretofore referred to.

The sprinkler frame 18 on the lower end of the tubular fitting 17 has the usual arms 25 which join one another on the axial center line of the passageway defined by the sprinkler frame 18 and on which center line a tension screw 25A and a deflector 26 are located as customary in the sprinkler act. A closure 27 normally closes the passageway defined by the sprinkler frame 18 and is held in closed relation by a strut 28 and an inverted L-shaped lever 29 by reason of a fusible cartridge 30, the ends of which are engaged in apertures in arms 31 on the strut 28.

Still referring to FIG. 1 of the drawings, it will be seen that a flared tube 32 is slidably positioned within the tubular fitting 17 and that an impact tube 33 is slidably positioned within the flared tube 32. The impact tube 33 is considerably shorter in overall length than the flared tube 32. The lower portion 34 of the flared tube 32 is of relatively smaller diameter than the remainder thereof and slidably engages the interior of the sprinkler frame 18 being disposed in the passageway defined thereby and is engaged against the inner surface of the closure 27.

A pair of coil springs 35 separated by a separator ring 36 are positioned between the narrower lower portion 34 of the flared tube 32 and the bottom end of the impact tube 33 and are normally tensioned so as to urge these parts in opposite directions. The upper end of the impact tube 33 is tapered to form a cutting edge 37, the taper extending along the exterior surface inwardly of the upper end thereof. The upper end of the flared tube 32 is flared outwardly as at 38 in the area of the tapered upper portion of the impact tube 33 and a plurality of spheres 39 are positioned partially therebetween and confined by a sphere retainer ring 40 all within the area defined by the slide fitting 22 heretofore referred to.

It will therefore be observed that in its normal condition, the adjustable dry pendent sprinkler as seen in FIG. 1 of the drawings, provides a first closure, the frangible disc 11, at its point of communication with the fitting F of the sprinkler distributing main, the water supply source of a sprinkler system, and provides a second closure at its opposite end, the closure 27 of the fusible sprinkler.

In FIG. 1 of the drawings broken lines at the lower part of the FIG. indicate the distance of the adjustable dry pendent sprinkler may be extended downwardly relative to the fitting F, the telescopically engaged tubular fitting 17 being slidable relative to the cylindrical barrel 14 and as it moves it will progressively present a series of annular grooves 41 to the disc retainer 16 heretofore referred to, so that it will be held in any adjusted position, for example by moving the tubular fitting 17 outwardly of the cylindrical barrel 14 to its maximum extension, the deflector 26 will move to the position shown in broken lines in the lower portion of FIG. 1 of the drawings and at the same time the lugs 24 on the inner lower surface of the cylindrical barrel 14 will engage in the pockets 23 in the slide fitting 22 so that the device may then be threadably engaged in the fitting F, for example, by forcefully turning the lower poriton of the tubular fitting 17. Once the top cap 10 is satisfactorily positioned in the fitting F, the tubular fitting 17 may then be moved telescopically inwardly of the cylindrical barrel 14 to bring the escutcheon plate 21 to the desired level of for example a false ceiling through which the device has been positioned.

Figure 2:
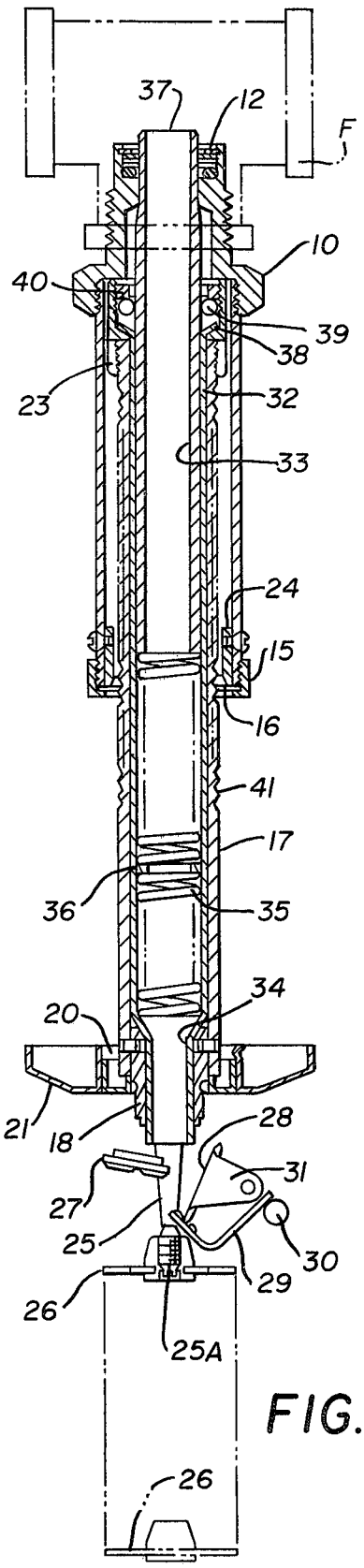
FIG. 2 is a vertical section through the device of FIG. 1 showing the heat fusible sprinkler open and the operation of the dry pendent sprinkler.

By referring now to FIG. 2 of the drawings, the operation of the adjustable dry pendent sprinkler may be seen. Operation occurs upon the fusible element 30, the cartridge of the sprinkler, reaching a predetermined temperature, for example 165° F., whereupon the ends of the cartridge 30 are freed from the apertures in the arms 31 of the strut 28 and the resultant action frees the inverted L-shaped lever 29 and permits the closure 27 to open the passageway defined by the sprinkler frame 18. When this occurs the lower portion 34 of the flared tube 32 will be moved downwardly forcibly by the lower one of the springs 35, which in effect uncages the spheres 39 held between the flared out upper poriton 38 of the flared tube 32 and the outer tapered surface of the impact tube 33 and permits the impact tube 33 to move upwardly as urged by the other one of the springs 35 so that its upper end comprising the cutter 37 engages and ruptures the frangible disc 11. The impact tube 33 and the flared tube 32 then form a tubular passageway between the fitting F of the sprinkler main and the discharge opening of the sprinkler frame 18 so that fire extinguishing fluid, such as water, in the sprinkler main is delivered against the deflector 26 in a cusomary manner as will occur to those skilled in the art.

It will thus be seen that an adjustable dry pendent sprinkler has been disclosed which may be practically and efficiently produced and easily installed and operates to provide a sprinkler discharge point at a desired distance with respect to a sprinkler distributing main in which it may be easily installed as it may be locked in assembly to facilitate such installation.

Although but one embodiment of the present invention has been illustrated and described, it will be apparent to those skilled in the art that various changes and modifications may be made therin without departing from the spirit of the invention and having thus described my invention what I claim is:

1. An adjustable dry pendent sprinkler comprising a telescopically engaged tubular fitting and a cylindrical barrel, means on one end of said cylindrical barrel for engagement in distributing piping, a frangible closure in said means, one end of said tubular fitting extending outwardly of the other end of the said cylindrical barrel, a normally closed sprinkler on said one end of said tubular fitting and a pair of telescopically engaged tubular members disposed within said tubular fitting, one of said tubular members being shorter than the other and slidably positioned within the other one, one end of said shorter tubular member being tapered exteriorly, and one end of the other tubular member being outwardly flared, said flared end being adjacent said tapered end, a plurality of spheres positioned between the flared and tapered ends of the tubular members arranged to normally prevent relative motion of said tubular members, springs engaging said tubular members normally urging them in opposite directions, said other longer one of said tubular members engaging said closed sprinkler and held stationary thereby whereby opening of said sprinkler upon reaching a predetermined temperature permits said springs to move the longer tubular member outwardly of said sprinkler and the flared and tapered end portions of the tubular members relative to one another to free said spheres for radial movement and permit said springs to move the shorter tubular member into engagement with said frangible closure so as to rupture the same.

2. The adjustable dry pendent sprinkler set forth in claim 1 and wherein inter-engaging means are formed on the tubular fitting and cylindrical barrel and are arranged for inter-engagement when said tubular fitting is moved out of said cylindrical barrel to the maximum degree possible whereby the adjustable dry pendent sprinkler may be forcefully rotated to threadably engage the same in said distributing piping.

3. The adjustable dry pendent sprinkler set forth in claim 1 and wherein the tapered end of said shorter tubular member is sharpened to form a knife-like edge facilitating the rupturing of said frangible closure when engaged thereagainst.

4. The adjustable dry pendent sprinkler set forth in claim 1 and wherein the end of the longer tubular member engaging said closed sprinkler is of relatively smaller diameter than the remainder thereof so as to form an annular shoulder and wherein said springs are engaged on said shoulder.

5. The adjustable dry pendent sprinkler set forth in claim 1 and wherein the lower end of said cylindrical barrel has an annular member thereon and an apertured disc is retained thereby in tensioned engagement with the exterior of said tubular fitting, whereby the tubular fitting may be maintained in fixed adjusted lengthwise relation to said cylindrical barrel.

6. The adjustable dry pendent sprinkler set forth in claim 1 and wherein an escutcheon is mounted on said sprinkler adjacent said one end of said tubular fitting so as to be movable therewith.

* * * * *